162-205 SR
11/20/84 OR 4,483,745

United States Patent [19]
Wicks et al.

[11] Patent Number: 4,483,745
[45] Date of Patent: Nov. 20, 1984

[54] METHOD AND APPARATUS OF SHEET TRANSFER USING A NONPOROUS SMOOTH SURFACED BELT

[75] Inventors: Laurie D. Wicks, South Beloit; Dennis C. Cronin; James L. Chance, both of Rockton, all of Ill.

[73] Assignee: Beloit Corporation, Beloit, Wis.

[21] Appl. No.: 428,241

[22] Filed: Sep. 29, 1982

[51] Int. Cl.[3] ..... D21F 3/04; D21F 3/00; D21F 11/00

[52] U.S. Cl. ..... 162/205; 162/206; 162/358; 162/360

[58] Field of Search ..... 162/205, 206, 305, 358, 162/359, 360

[56] References Cited

U.S. PATENT DOCUMENTS 2,744,453 5/1956 Hornbostel ..... 162/359 X
3,023,805 3/1962 Walker ..... 162/358
3,293,121 12/1966 Martin ..... 162/358
4,201,624 5/1980 Mohr et al. ..... 162/205
4,219,383 8/1980 Valkama ..... 162/360

*Primary Examiner*—S. Leon Bashore
*Assistant Examiner*—K. M. Hastings
*Attorney, Agent, or Firm*—Hill, Van Santen, Steadman & Simpson

[57] ABSTRACT

A method and mechanism for positive web transfer in a press section of a papermaking machine including an intermediate press nip formed between first and second press members with a porous felt on one surface of the web and a nonporous looped smooth surface belt of nonextensible material impervious to water passing through the nip in direct contact with the other surface of the web so that the web follows the belt downstream of the nip with the web first being pressed between an earlier press upstream of the intermediate press, and the web being removed from the belt following the intermediate press with rewetting of the web on the offrunning side of the intermediate nip due to contact with the impervious belt being eliminated.

9 Claims, 4 Drawing Figures

METHOD AND APPARATUS OF SHEET TRANSFER USING A NONPOROUS SMOOTH SURFACED BELT

BACKGROUND OF THE INVENTION

The invention relates to improvements in papermaking machines, and more particularly to a method and mechanism for positive web transfer and control without rewetting in the press section of a paper machine.

In the transfer of a web between presses or from a press to a dryer, different structures and method have been employed. One arrangement is to carry the web across an open draw. However, since the sheet is unsupported, the open draw often limits the maximum machine speed due to the strength of the sheet. With types of webs made of short fibers or pulp such as bagasse, and with constructions wherein the sheet is unusually wet and heavy, breakage can occur much too easily in an open draw due to sheet flutter or normal stresses so that the use of open draws is limited to lower speeds and certain types of webs.

Another form of sheet transfer is with the sheet carried on a felt. This arrangement eliminates the problems of sheet breaks at an open draw, but there is a disadvantage in that a considerable amount of rewetting of the sheet from the felt occurs. The rewetting is counterproductive inasmuch as the function of the press is to remove as much moisture as possible to reduce the thermal energy expenditure necessary in the paper machine dryer section.

Another form of sheet transfer is on a press roll and although this eliminates the disadvantages of both the open draw and the rewetting of the sheet in felt transfer, there are geometric problems involved in having enough space around the roll to install all the associated press equipment for such transfer. The location and transfer space is determined by the location of the surface of the press roll.

It is accordingly an object of the present invention to provide an improved method and structure for the transfer of a web between presses or from a press to a dryer in a papermaking machine which eliminates the disadvantages accompanying open draw transfer, felt transfer or direct roll transfer.

A further object of the invention is to provide an improved web transfer arrangement in which the web is under complete control to avoid breakage, wherein rewetting from a felt is eliminated, and space problems are not limiting as to where the transfer is to take place.

A feature of the invention is to provide press arrangements which can either be the typical roll couple press or what has become known as extended nip press wherein prior to the transfer, the web is sandwiched between a felt and a looped endless belt which is smooth and relatively hard so that no rewetting of the sheet occurs on the offrunning side of the press nip and the sheet follows the belt after the press nip to be subsequently removed therefrom for the transfer. This arrangement utilizes the phenomena known to papermakers that the web will follow the surface having the greatest density and will follow a smooth impervious surface rather than a felt when the two are separated.

Other objects, advantages and features, as well as equivalent structures and methods which are intended to be covered herein will become more apparent with the teaching of the principles of the invention in connection with the disclosure of the preferred embodiments thereof in the specification, claims and drawings, in which:

DRAWINGS

DESCRIPTION

Figure 1:
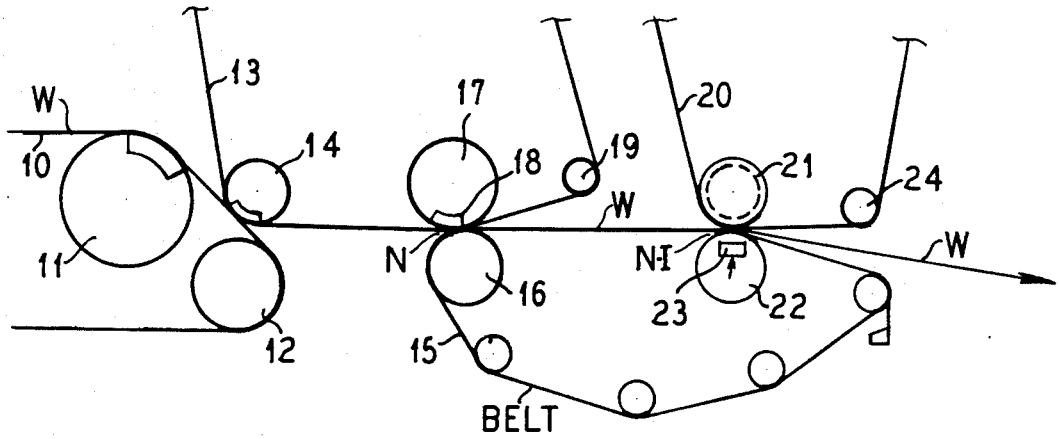
FIG. 1 is a schematic elevational view showing a press section of a papermaking machine constructed and operating in accordance with the principles of the present invention.

As illustrated in FIG. 1, a web W is formed on a forming wire 10 which passes down over a couch roll 11 and a turning roll 12. On the downrunning transfer run of the wire, the web is picked off the wire by a pick-up felt 13 passing over a pick-up roll 14 having a suction gland therein.

The web is carried on the underside of the felt to a press nip N formed between an upper press roll 17 and the lower press roll 16. Water is transferred from the web into the felt 13 in the press nip N with the upper press roll 17 being a suction roll with a gland therein or being another form of open roll such as a grooved roll. On the offrunning side of the nip N a guide roll 19 leads the felt 13 away from the nip and away from the web.

On the underside of the web in the nip N, the web is sandwiched between the felt 13 and an endless traveling impervious belt 15. The belt has a smooth upper surface and has a smoothness and a hardness or density generally similar to a plain press roll cover, and therefore the belt acts like an expanded press roll carrying the sheet onwardly to the next press. The belt surface preferably has a hardness in the range of between 10 and 200 P&J.

Since the belt surface is impervious to water, there is no rewetting of the sheet when carried on the belt, on the offrunning side of the nip N as in the case of when a felt is used and the sheet transfer is accomplished on a felt.

The web or paper sheet follows the belt 15 following the first press nip N since the belt has a smoother or more dense surface. Also, the web is not in contact with a felt between presses, as it travels to an intermediate press nip N-I so that rewetting does not occur during the travel time between press nips.

While the presses shown as N and N-I are illustrated as conventional roll presses, extended nip presses may be employed, and the same advantages of the use of the impervious belt occurs. Extended nip presses, as will be recognized by those versed in the art, are presses utilizing elongate press nips where the pressing pressure may be obtained such as from a dynamic layer of hydraulic liquid.

The press nip N-I which may be termed an intermediate nip is formed between a first press member 21 and a second press member 22 defining a pressing zone therebetween through which the web is carried subject to a dewatering pressure. A porous felt 20 which may be termed an intermediate felt is on one surface of the web carried on the first press roll 21 which may be a grooved roll or a suction roll. The second press roll 22 is a solid roll and may be an extended press nip as indicated symbolically by the rectangle 23 or the rectangle 23 may designate a controlled crown support shoe which runs inside of a hollow roll shell 22.

Following the nip N-I, the felt 20 is separated from the nip over a guide roll 24, and the web W is pulled off of the impervious belt 15 by suitable mechanism, not shown, and the web will follow the belt on the offrunning side of the nip N-I. The web at this location in travel will have been dewatered sufficiently to gain strength to be drawn off of the belt.

Figure 2:
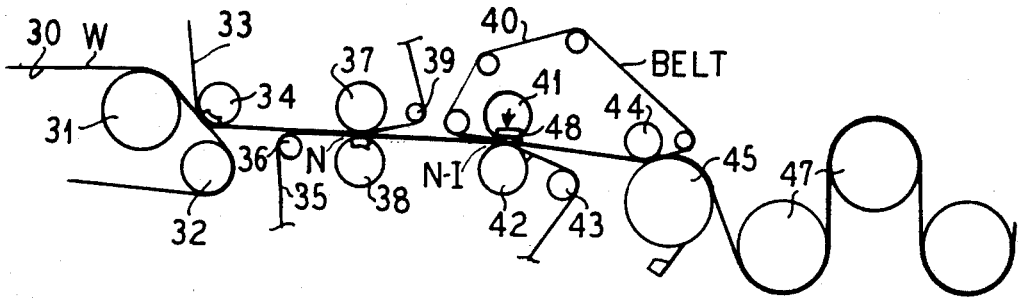
FIG. 2 is another schematic elevational view showing another form of the invention.

In the arrangement of FIG. 2, similar to FIG. 1, a web W is carried through a first press before passing through an intermediate press, and in the intermediate press, one side of the web is supported by a nonporous smooth belt. In FIG. 2, there is a closed transfer from the press to the dryers, rather than an open draw as illustrated in FIG. 1.

Referring to FIG. 2, a web is formed on a forming wire 30 which passes down over a couch roll 31 and a turning roll 32 in a downrunning transfer run. In the transfer run, the web is transferred to a first felt 33 which passes in pick-up relation to the wire 30 over a pick-up roll 34 with a pick-up gland therein. An intermediate felt 35 is brought up under the web, guided by a roll 36, and the web is carried through a double felted first press nip N. The first press is formed between an upper press roll 37 and a lower press roll 38 which may be of various forms, and as illustrated the lower press roll 38 is an open roll such as a grooved roll or roll shell with a suction gland therein. The suction gland transfers the web to the lower felt 35, and the upper felt is guided away from the nip N by a roll 39.

The web is then carried to an intermediate press nip N-I formed between the first press member 41 and a second press member 42. 41 may be a supported controlled deflection roll or an extended press type of roll as indicated by a schematic shoe 48 within the roll shell. In each of the arrangement of FIGS. 1 and 2, the solid impervious belt 15 and 40 respectively will function as a web carrying member preventing rewetting and can also function as the belt as part of an extended nip arrangement with a sliding shoe therein indicated respectively at 23 and 48. In the sliding shoe arrangement, as is conventional with one form of extended nip, the shoe will be shaped to conform to the roll on the opposite side of the nip and will have a relieved leading edge with means for delivering a hydraulic liquid to the leading edge so that a film of dynamic hydraulic liquid builds up between the belt 40 and the shoe.

In FIG. 2 on the offrunning side of the nip N-I, the lower felt 35 is separated from the web by being led away by a roll 43. The web will follow the smooth impervious belt 40 to a last nip formed between an upper roll 44 and a lower roll 45. The last nip may be merely be a transfer nip with the web transferring onto the smooth lower roll 45 to be carried through a dryer section with successive dryer drums 47, and additional supporting felts are led onto the web in a conventional manner.

Figure 3:
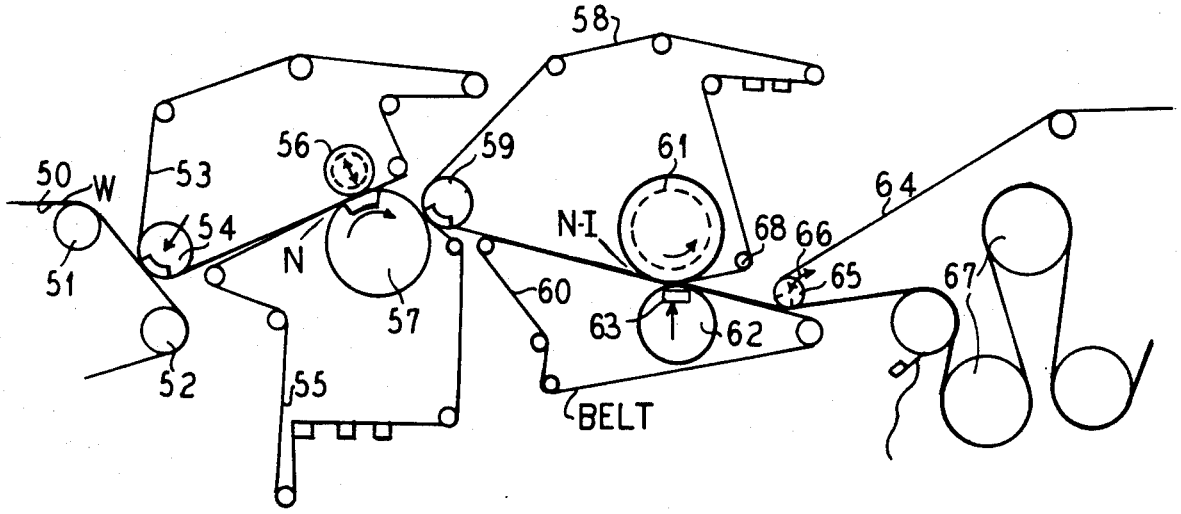
FIG. 3 is another schematic elevational view showing still another form of the invention.

In FIG. 3, a web W is formed on a forming wire 50 led down through a pickup run over a couch roll 51 and a turning roll 52. The web is picked off the wire 50 by pick-up felt 53 running over a pick-up roll 54 with a pick-up gland therein. A lower felt 55 is brought up underneath the upper felt 53 to sandwich the web therebetween and carry it through a double felted first nip N. The first nip is formed between an upper roll 56 and a lower roll 57 which has a gland therein to transfer the web to the lower felt on the offrunning side of the nip N.

The web is picked off the lower felt by a pick-up roll 59 having a gland therein supporting a porous intermediate felt 58. A porous looped impervious belt 60 is brought up beneath the web to carry it through an intermediate nip N-1 formed between an upper press roll 61, which may be an open roll such as a grooved roll, and a lower press roll 62. The lower roll may be an extended nip press arrangement having a shoe 63 or a controlled deflection roll.

The web will follow the impervious belt on the offrunning side of the nip N-I, and the upper felt 58 is led away from the nip by a roll 68. The web is picked off the smooth impervious belt by a felt 64 traveling over a pick-up roll 65 having a pick-up gland therein, and the roll 65 is adjustable in position to bring it into pick-up touch contact with the belt. The felt 64 then carries the web through a series of dryer drums such as 67. In this arrangement, the web is under supportive control at all locations and rewetting at the final nip N-I is prevented by the one-piece impervious belt 60.

Figure 4:
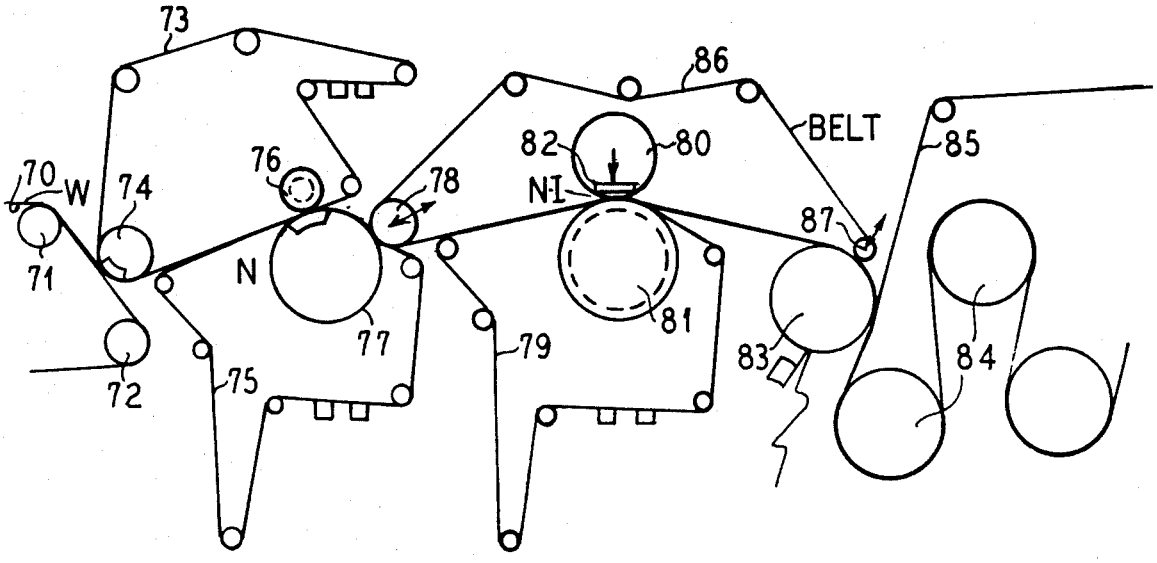
FIG. 4 is a further schematic elevational view showing a still further form of the invention.

In FIG. 4, a web W is formed on a traveling forming wire 70 which is guided down over a couch roll 71 and a turning roll 72 in a pick-up run. The web is picked off of the wire by an upper felt 73 guided into pick-up relationship with the web by pick-up roll 74 having a pick-up gland therein. A lower felt 75 is brought up under the web so that it is carried in double felted arrangement through a first press nip N. The nip is formed between an upper press roll 76 and a lower press roll 77 which is a suction roll with a gland therein to transfer the web to the lower felt 75. On the offrunning side of the nip, a plain surfaced roll 78 carrying a one-piece smooth belt 86 is pressed into the felt to transfer the web W. The web will transfer to the smooth surfaced belt from the felt, and the roll 78 will be adjustable for this purpose. A lower porous felt 79 is brought up beneath the web to carry it through an intermediate nip N-1 formed between an upper press roll 80 and a lower press roll 81. The upper roll may be an extended nip roll with a shoe 82 therein, or a controlled crown roll or similar suitable support roll for the nip N-1.

The web will follow the smooth surfaced belt 86 on the offrunning side of the nip N-1, and will automatically transfer to a smooth surface roll 83 which is pressed into the belt a controlled amount by a movable belt guide roll 87. On the downrunning side of the smooth surface roll 83, the web is lifted off of the roll onto a felt 85 which carries it through a series of dryer drums 84.

In operation various arrangements are used for the initial press, but generally speaking an intermediate press nip is utilized formed between a first press member and a second press member defining a pressing zone therebetween with a porous felt on the surface of the web and an impervious nonporous smooth surface belt on the other side so that the web follows the belt on the offrunning side of the nip and is not rewet by the belt at the downside of the nip or while the web is being carried on the belt.

Thus, it will be seen that we have provided an improved mechanism for positive web transfer in a press of a papermaking machine which meets the objectives and advantages above set forth and accommodates improved handling with space conservation and enabling higher speed secure transfer of a web without rewetting.

We claim as our invention:

1. A mechanism for positive web transfer in a papermaking machine comprising in combination:

means forming a first press nip formed between a first press roll and a second press roll;

means forming a second press nip between a third and a fourth press roll;

a nonporous looped smooth surfaced belt of nonextensible material impervious to water passing sequentially through said first and second nips in direct supporting contact with one surface of the web so that the web follows the belt and is nonextensibly supported thereby in travel through the nips;

a porous felt means on the other surface of the web passing through said first and second nips and receiving water pressed from the web;

means guiding the belt away from the second nip;

and means receiving the web from the belt and separating the web therefrom following the second nip.

2. A mechanism for positive web transfer in a papermaking machine constructed in accordance with claim 1:

wherein the belt is of a material having a hardness between 10 and 200 P&J.

3. A mechanism for positive web transfer in a papermaking machine constructed in accordance with claim 1:

wherein said belt passes beneath the web in its travel through the first and second nips.

4. A mechanism for positive web transfer in a papermaking machine constructed in accordance with claim 11:

wherein said felt means includes first and second felts with the first felt passing through the first nip and separating from the web on the offrunning side and the second felt passing through the second nip and separating from the web on the offrunning side of the second nip.

5. A mechanism for positive web transfer in a papermaking machine constructed in accordance with claim 1:

including an initial dewatering nip positioned in advance of said first and second nips with means for carrying the web through said initial nip and transferring the web to said belt.

6. A mechanism for positive web transfer in a papermaking machine comprising in combination:

means forming a press nip between a first press roll and a second press roll;

a nonporous looped smooth surfaced belt of nonextensible material impervious to water passing through said nip in direct contact with the surface of the web in supporting relationship thereto;

a porous felt on the other surface of the web passing through the nip and receiving water pressed from the web in the nip;

means carrying the web to the felt and belt;

means guiding the belt away from the nip;

and means receiving the web from the belt and separating the web therefrom.

7. A mechanism for positive web transfer in a papermaking machine constructed in accordance with claim 6:

wherein said means carrying the web to the belt includes a pickup felt arranged to receive a web from a forming wire and a second felt with a roll couple forming a press nip pressing the web between the pickup felt and first felt prior to its delivery to said belt.

8. A method of positively transferring a web through a press section of a papermaking machine between first and second press nips each formed of a roll couple comprising the steps:

carrying the web on a nonporous looped smooth surface belt of nonextensible material impervious to water and passing the belt through the nips in direct supporting relationship with the web; and passing a felt means through each of said nips for receiving water pressed from the web with the felt means being on the side of the web opposite the belt.

9. A method for positive web transfer in a press section of a papermaking machine in accordance with the steps of claim 8:

wherein the web is first pressed between two opposed felts upstream of the roll couples and thereafter transferred to the belt.

* * * * *

UNITED STATES PATENT AND TRADEMARK OFFICE

CERTIFICATE OF CORRECTION

PATENT NO. : 4,483,745

DATED : November 20, 1984

INVENTOR(S) : Laurie D. Wicks, Dennis C. Cronin & James L. Chance

It is certified that error appears in the above-identified patent and that said Letters Patent are hereby corrected as shown below:

Claim 4, line 3, please change the numeral "11" to --1--.

Signed and Sealed this

*Twenty-eighth* Day of *May 1985*

[SEAL]

*Attest:*

DONALD J. QUIGG

*Attesting Officer*

*Acting Commissioner of Patents and Trademarks*